United States Patent [19]

Busatto et al.

[11] 3,933,494

[45] Jan. 20, 1976

[54] METHOD FOR OBTAINING A COLOR CONTRAST PHOTOGRAPHIC IMAGE BY COLOR DEVELOPMENT AND SILVER SALT DIFFUSION TRANSFER PROCESSING OF ONE PHOTOGRAPHIC ELEMENT

[75] Inventors: Vinicio Busatto, Savona; Luigi Franchi, Ferrania, Savona, both of Italy

[73] Assignee: Minnesota Mining and Manufacturing Company, St. Paul, Minn.

[22] Filed: Nov. 8, 1973

[21] Appl. No.: 413,966

[30] Foreign Application Priority Data

Nov. 15, 1972 Italy ..... 54051/72

[52] U.S. Cl. ..... 96/29 R; 96/55; 96/76 R; 96/77

[51] Int. Cl.[2] .. G03C 5/54; G03C 7/00; G03C 1/48; G03C 1/40

[58] Field of Search ..... 96/29 R, 76 R, 77, 55

[56] References Cited

UNITED STATES PATENTS

| | | | |
|---|---|---|---|
| 2,698,237 | 12/1954 | Land | 96/29 R |
| 2,712,995 | 7/1955 | Weyde | 96/29 R |
| 3,227,550 | 1/1966 | Whitmore et al. | 96/3 |
| 3,585,028 | 6/1971 | Stephens | 96/29 D |
| 3,689,272 | 9/1972 | Schwan et al. | 96/3 |
| 3,787,209 | 1/1974 | Land | 96/29 R |

*Primary Examiner*—David Klein
*Assistant Examiner*—Richard L. Schilling
*Attorney, Agent, or Firm*—Alexander, Sell, Steldt & DeLaHunt

[57] ABSTRACT

Color contrast photographic images may be produced in a photographic element comprising:

1. a base
2. at least one layer of a silver halide photographic emulsion dispersed in a hydrophilic colloidal binder and reactively associated with at least one color coupler, and
3. at least one hydrophilic colloidal binder receptive layer containing dispersed silver condensation nuclei for the formation of colored colloidal silver, reactively associated with said emulsion layer, said nuclei and coupler selected to give rise to substantially differing colors by developing said photographic element in the presence of a p-phenylene diamine developer and carrying agent for silver halide.

13 Claims, 8 Drawing Figures

Figure 2:
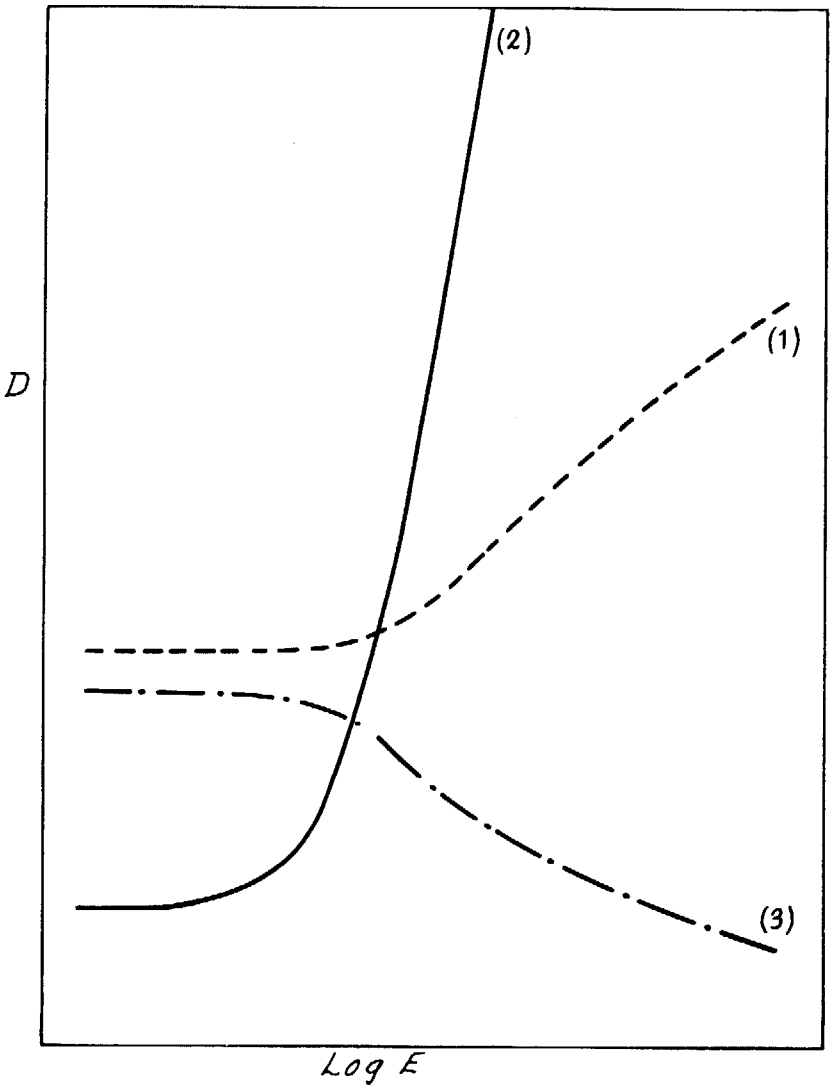
Figure 1:
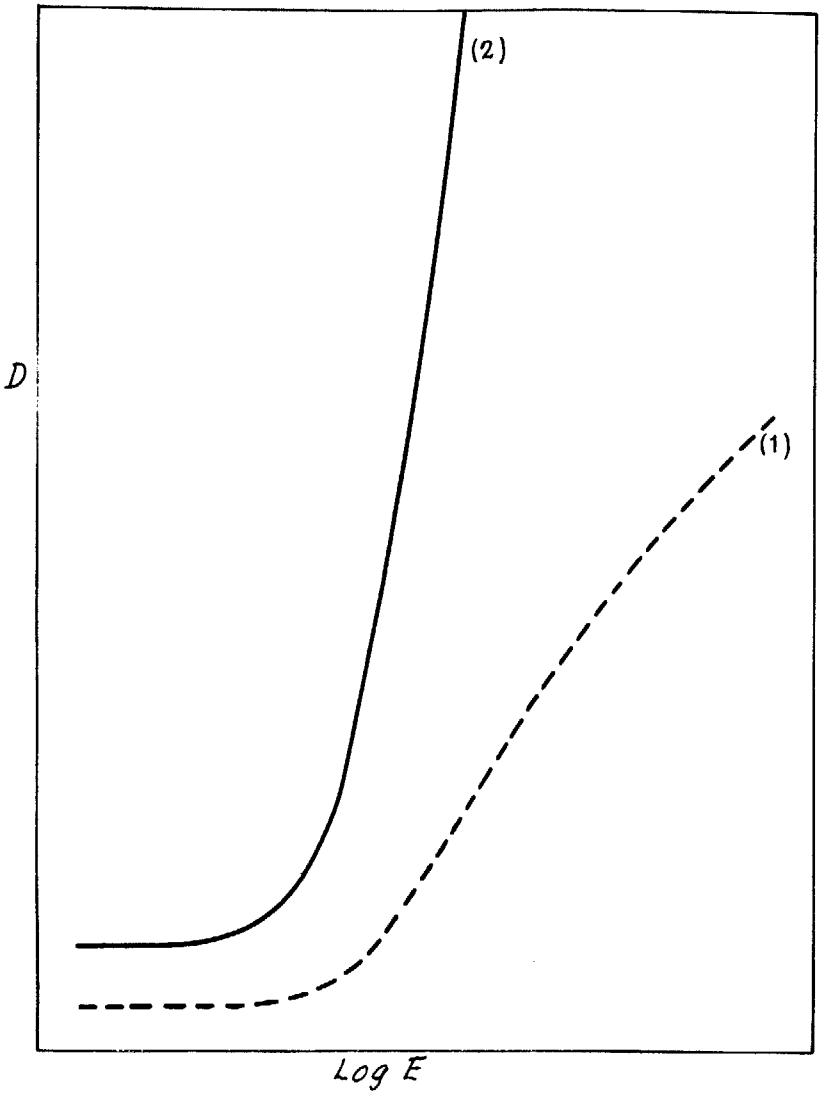
Figure 4:
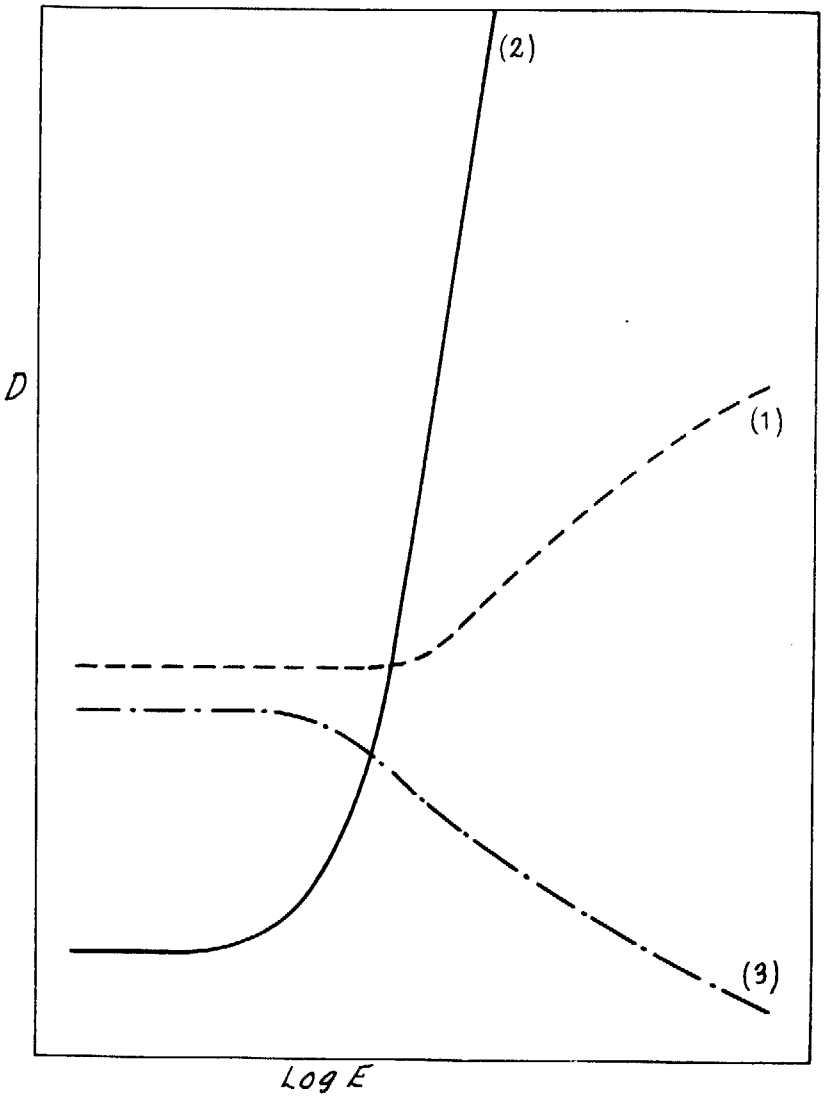
Figure 3:
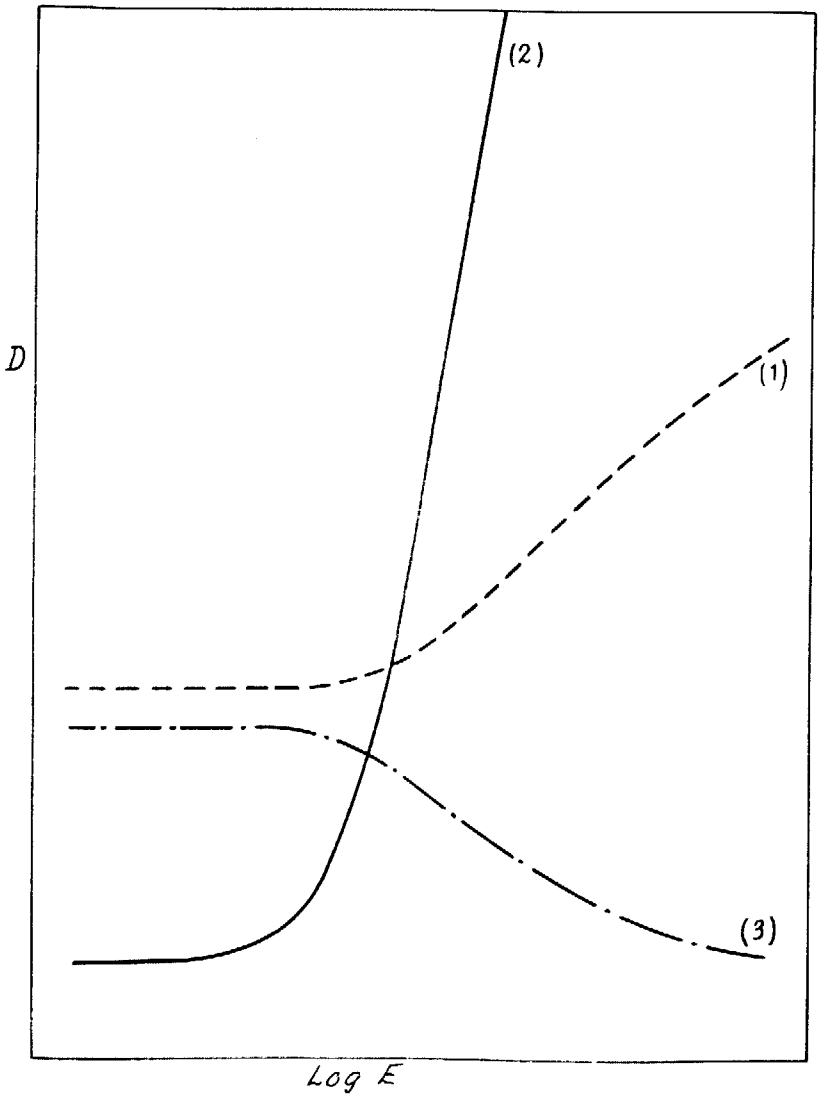

METHOD FOR OBTAINING A COLOR CONTRAST PHOTOGRAPHIC IMAGE BY COLOR DEVELOPMENT AND SILVER SALT DIFFUSION TRANSFER PROCESSING OF ONE PHOTOGRAPHIC ELEMENT

It is known in the photographic art that an image of a subject can be obtained in three different ways which, according to the terminology used in the present patent application, respectively correspond to black and white, color and color contrast photography.

A black and white photographic system is capable of producing an image of the subject by means of a grey scale on an opaque, generally white background or on a transparent, colorless, or colored background. The various grey densities correspond to different quantities of reduced silver.

In the particular case of radiography, the subject is generally reproduced on a transparent colorless or colored background by means of a grey scale which modulates a negative image (i.e., the parts of the subject transparent to X-rays appear dark and those opaque to X-rays appear bright).

A color photographic system is capable of producing an image of the colored subject in two or more scales of distinct colors, being substantially all negative or all positive.

A color contrast photographic system is capable of producing an image of the colored subject in two opposite scales of distinct colors, one being negative and the other positive. In both cases, the colors can be conveniently chosen so that they can "create a contrast." Two colors, for instance, "create a contrast", in the above specified sense when they are complementary, such as for instance blue and yellow. Various color combinations could be chosen, for example blue and orange, blue and red, or magenta and yellow, but it is generally accepted in the art that the best combination is blue and yellow.

A color contrast photographic system is particularly useful in all those cases where an exact reproduction of the colors of the subject is not required, such as in medical and industrial radiography.

Both the color and the color contrast systems hitherto developed to be used in radiography have turned out to be of little practical importance and either represented a mere curiosity or were only used for particular studies or teaching aims. Such limited use was due to the fact that such systems were too complicated and required excessively long processing sequences. Systems of this type are described for instance in the following patents: U.S. Pat. Nos. 2,644,096; 2,593,925; 2,931,904; 2,807,725; 2,906,881; Swiss Pat. No. 295,100; German Pat. Nos.: 970,220; 977,204; 1,011,277; 1,046,495; 1,076,490; 1,135,754; German Pat. applications (OS) Serial Nos. 1,946,652 and 2,045,399; French Pat. Nos. 1,056,200; 1,190,520; 1,283,925 and British Pat. No. 716,064.

The German Patent application OS Ser. No. 1,946,652 particularly describes a method for viewing a monochrome photographic image with artificial color contrast, such a method consisting of examining it through various colored filters.

One aspect of the present invention is to provide a simplified method for obtaining color contrast photographic images.

Another aspect of the present invention is to provide photographic element suitable for the realization of such a method and, in particular, photographic elements suitable for a radiographic color contrast use.

Another aspect of the present invention is to provide a developing composition particularly useful for obtaining color contrast images.

According to the present invention, we have found that a color contrast image can be obtained from an exposed photographic element comprising:

1. at least one layer of silver halide emulsion in reactive association with a color coupler, and
2. in non-strippable reactive association with (1), at least one layer containing nuclei (hereinafter called "silver condensation nuclei") which catalyze the reduction of silver ions in unexposed silver halide grains into the form of colored colloidal silver by developing said element with a developer, the oxidation product of which is capable of coupling with the color coupler in the at least one layer of silver halide emulsion said developing being in the presence of a compound (hereinafter called "a carrying agent") capable of carrying silver ions from unexposed silver halide in the emulsion to the layer (hereinafter called "receptive layer") containing the silver condensation nuclei.

The above process is believed to perform in the following manner:

1. exposed silver halide grains in the emulsion are reduced by the action of the developer, in turn oxidizing the developer,
2. the oxidized developer then couples with color coupler in the emulsion layer,
3. unexposed and unreduced silver (still in the ionic form of silver halide) is then picked up by the carrying agent and migrates to the receptive layer
4. where the carried silver is catalytically deposited on the silver condensation nuclei.

The catalytic deposition of the silver in the receptive layer produces one distinct color in the image region of non-exposure, and the color coupler and oxidized developer form a selected color (depending upon the color coupler selected) in the image region of exposure. In those portions of the image where there are both exposed and unexposed portions, the two separate color producing methods act to form a continuous blend or shift from one color to the other. In the case of a blue forming coupler and yellow colloidal silver for example, the intermediately exposed regions will be green (the blue and yellow colorations being additive). One color image may in fact be regarded as the negative image of the other color image. This is because while exposure creates the positive dye image, the unexposed areas generate the positive colloidal silver image. The coupler and condensation nuclei are selected so as to have contrasting colors produced by the two color producing processes, coupling and catalytic deposition. The preferred colors are a substantially blue negative image (from the dye) and a substantially yellow positive image (from the condensation nuclei).

It should be apparent that because of the nonstrippable (inseparable) reactive association of the emulsion and receptive layer, the silver ions carried from the emulsion to the receptive layer are in the form of an image.

According to a particular aspect of the present invention, we have found that the color contrast of the image obtained with the above-described method can be increased if the color development occurs in the presence of a compound of the methol and phenidone classes, preferably the phenidone class of developers.

According to another view of the present invention, we have found that the color contrast of the image obtained with the above-described method can be increased if the development occurs with the presence of a non-diffusing derivative of hydroquinone in the receptive layer.

In its most general aspects, the present invention briefly relates to a method for obtaining a color contrast photographic image which consists of processing an exposed photographic element including:

1. a base;
2. at least a layer of a silver halide emulsion dispersed in a hydrophilic colloidal binder and reactively associated with a coupler;
3. at least a receptive layer of a hydrophilic colloidal binder containing dispersed silver halide condensation nuclei reactively associated with said emulsion layer, in the presence of:

4. a color developing agent;
5. a carrying agent for the silver halide, said condensation nuclei, said coupler and said color developing agent being chosen so that two different colors are formed during development, thus obtaining a color contrast image.

The present invention particularly relates to a method, as described above, wherein the color developing agent and/or the carrying agent are introduced into the processing bath.

The present invention more particularly relates to a method as described above wherein the condensation nuclei are colloidal silver nuclei and/or the color developing agent is a compound of the p-phenylene diamine class.

The present invention more particularly concerns a method of the above-described type, wherein said carrying agent for the silver ions is a compound (preferably thiosulfate or sulfocyanide compounds and more preferably thiosulfate ions) which with silver forms water-soluble complexes.

The present invention more particularly relates to a method of the above-described type, wherein the color developer may be associated with a non-color developer of the methol and phenidone, preferably phenidone type.

The present invention further particularly relates to a method of the above-described type, wherein said receptive layer also contains non-diffusing compounds of the hydroquinone class carrying one or more ballasting groups, for instance alkyl groups, altogether having for instance from 10 to 18 carbon atoms (e.g., diisooctylhydroquinone). It has been found that this class of ballasted hydroquinones in the receptive layer favors the reduction and deposition of silver ions in the receptive layer which increases the efficiency of the photographic element.

The present invention further relates to a photographic element suitable for the realization of the above-described method, said element including:

1. a base;
2. at least one layer of silver halide emulsion dispersed in a hydrophilic colloidal binder in reactive association with at least one color coupler;

3. at least one hydrophilic colloidal binder receptive layer containing dispersed silver condensation nuclei;

said receptive layer and said emulsion layer being in reactive association, (reactive association meaning that the unexposed silver halide during the color development must be capable of migrating from the emulsion layer to the receptive layer when carried by the carrying agent).

The present invention further particularly relates to a photographic element of the above-described type, wherein the condensation nuclei are colloidal silver nuclei (preferably being yellow "formers" upon condensation).

The present invention more particularly refers to a photographic element of the above-described type in which said emulsion layer contains a blue forming coupler.

The present invention more particularly relates to a photographic element of the above-described type in which said emulsion layer and said receptive layer are in adjacent positions in the photographic element.

The present invention more particularly relates to a photographic element of the above-described type in which said receptive layer contains compounds of the non-diffusing hydroquinone type, i.e., carrying one or more ballasting groups, for instance alkyl groups altogether having from 10 to 18 carbon atoms.

The present invention further relates to a developing composition suitable for the realization of the above-described process, such a composition including a color developer of the p-phenylene diamine class and a carrying agent of the thiosulfate or thiocyanate, preferably in combination with an agent of the methol or phenidone class, more preferably the phenidone class. Any "condensation" nuclei for silver ions (which can be free or under the form of complexes) as colored colloidal silver, in the above-described sense, are useful to the scope of the present invention. Silver sulfide under the form of colloidal particles can be useful. Applicants' experience, however, has been that the best results can be obtained with colloidal silver nuclei. These can be obtained with methods known to these skilled in the art, such as for instance according to Luppo-Cramer, v. "Inorganic Colloid Chemistry," Vol. I, The Colloidal Elements, by H. B. Weiser, published by John Wiley and Sons.

According to the scope of the present invention, both the color of said colloidal silver nuclei and the color of the colloidal silver image-wise formed upon "condensation," depend on their size, and therefore on their preparation method, and on the quantity present in the layer. Within certain limits, therefore, the skilled artisan will be able to choose the most useful color for the nuclei with respect to the coupler associated with the silver halide emulsion layer, as described above.

The best results can be obtained with yellow forming silver nuclei. They are preferably introduced into the receptive layer in a quantity ranging from 0.100 g. to 1 g. per 100 g. of hydrophilic colloidal binder.

Non-diffusing compounds of the hydroquinone class (e.g., diisooctylhydroquinone) introduced into the receptive layer surprisingly allow a better modulation of the positive image. Compounds of this type are preferably introduced in a quantity ranging from 30 g. to 150 g. per 1 g. of colloidal silver. They are introduced into the layer by well known solvent dispersion techniques hereinafter described in connection with the couplers.

The coupler(s) to be put in association with the emulsion, as described above, can be chosen so that, upon coupling reaction with the developer, the desired color will be formed. Such a coupler can be selected from the classes known to those skilled in the art, such as for instance phenols, naphthols, 5-pyrazolone compounds and compounds of the benzoylacetanilide type described for instance in the U.S. Pat. Nos. 2,367,531; 2,369,929; 2,423,730; 2,369,489; 2,600,788; 3,062,653; 2,407,210; 2,439,352; 2,728;658; 3,408,194; 3,447,928 and in the Italian Patent Applications Ser. Nos. 37,798A/69; 37,892A/69; and 55,062,A/71 of the applicant. Typical couplers of this type are for instance the following:

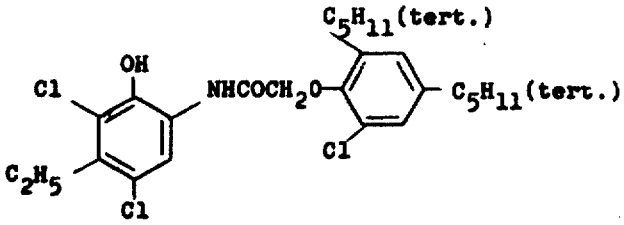

(1

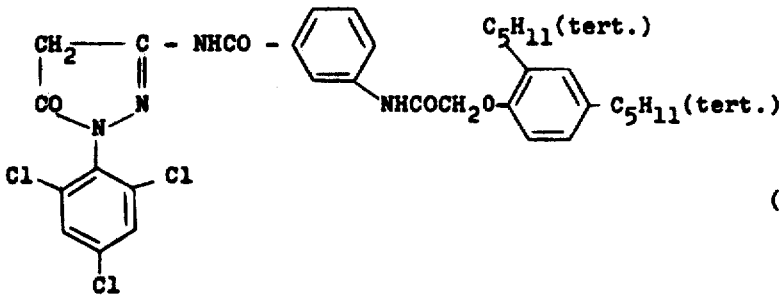

(2

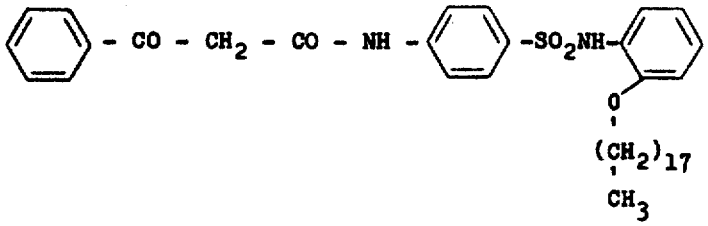

(3

Good color contrast can be conveniently obtained by using yellow colloidal silver condensation nuclei, dispersed in the receptive layer, together with blue forming couplers associated with the silver halide emulsion layer. As known to those skilled in the art, the couplers can be considered associated with the emulsion layer when they are contained either in this emulsion or in a layer adjacent the same, or even when they are introduced into the photographic element so that they can react with the developer in the presence of the exposed silver halide to form a colored dye.

It is possible to introduce an "additional" coupler to the main coupler in association with the emulsion layer with the aim of adjusting the obtained color (such as for instance a magenta forming coupler added with a blue forming coupler). It is also possible to introduce an "additional" coupler associated with the receptive layer containing the silver condensation nuclei (such as for instance a magenta forming coupler and/or a yellow forming coupler added to yellow forming nuclei). In any case, the couplers can be introduced into the photographic layers by methods known to those skilled in the art, such as for instance by the Fisher technique which consists of introducing them into the layer after having been dissolved in alkali water solutions (in this case, the coupler would preferably contain solubilizing groups of the COOH and $SO_3H$ type) or by the solvent dispersion technique. The latter briefly consists first of dissolving the coupler in a substantially water-immiscible organic solvent and then of dispersing the so-prepared solution in extremely fine droplets in a hydrophilic colloidal binder, as described for instance in the U.S. Pat. Nos. 2,322,027; 2,801,170; 2,801,171; 2,870,012 and 2,991,177.

The "main" coupler is preferably added in a quantity ranging from 0.050 moles to 0.3 moles/gramatom of silver and the "additional" coupler is preferably added in a quantity ranging from 0.015 moles to 0.10 moles/gramatom of silver.

The color developing agents to be used in the practice of this invention are those whose oxidation product (from the reduction of silver ions) will couple with color photographic couplers. For the generation of particular colors, the developer and coupler must be selected appropriately; however, the process mechanism is amenable to any such developer. Most preferred in the practice of this invention is the p-phenylene diamine class of photographic developers, described for instance in U.S. Pat. Nos. 2,193,015; 2,656,273; 2,875,049; and in *The Theory of the Photographic Process*, 3rd Ed. Mees and James, pp 294–295.

Typical developers which can be used for the development of photographic elements comprising the couplers of the present invention include the sulfites, the chlorohydrates and the sulfates of:

*a*. N,N-diethyl-p-phenylene diamine;

*b*. N-ethyl-N-β-methansulphonamido-ethyl-3-methyl-4-aminoaniline;

*c*. *N-ethyl,N-hydroxyethyl*-2-methyl-p-phenylene diamine;

*d*. N-ethyl,N-hydroxyethyl-p-phenylene diamine;

*e*. N,N-diethyl-2-methyl-p-phenylene diamine.

carrying agents, as described above, in the presence of which the development must occur, are all those compounds capable of linking with silver ions (as in the form of complexes) and of transporting them in an aqueous solution during the processing sequence from the emulsion layer to the receptive layer so that they can be reduced by the condensation muclei. These carrying agents are therefore those materials which effectively increase the solubility of silver ions, such as photographic fixing agents, for example. Compounds of this type are for instance thiosulfate or sulphocyanide ions liberated for instance by thiosulfate and an alkali or ammonium sulphocyanide, or those substances used in "transfer" systems, such as 1,1-bis-sulfonylalkanes described in the Belgian Pat. Nos. 767,951 and 767,952. Preferred carrying agents according to the present invention are the thiosulfate ions.

As known to those skilled in the art, the developing bath can be either a bath capable of activating the developing agent or a bath containing the developing agent. In the first case, the developing agent and possibly the carrying agent can be directly contained in the photographic element of the present invention. In the second case, the developing bath can contain the carrying agent and any other addition useful to the scope of the present invention. The addition of a non-color developer of the methol and phenidone classes particularly phenidone type, which not only allows more complete development of the exposed silver halide but also a better modulation of the positive image, turned out to be surprisingly useful. Obviously, it must be dosed in such a way that it must be dosed in such a way that it does not disturb the color development (optimum quantities can be found from time to time with routine methods). The developing bath can contain other additives known to the skilled artisan, viz. development restrainers, such as for instance potassium bromide; antioxidants, such as for instance sodium sulfite and an alkali agent of the alkali hydrate or carbonate type. It can further contain an antifoggant, such as for instance of the benzimidazole, benzotriazole, triazole and tetrazole type and their derivatives, such as mercapto-derivatives and an anticalcium substance of the alkali phosphate type and alkylendiamino polyacetic acids, such as for instance EDTA.

The optimum quantities, in which the single compounds are introduced, varies from time to time according to the material type to be processed.

The preferred quantities of the developing agent range from 1 to 15 g/l. of solution; those of the carrying agent from $3.10^{-4}$ to $6.10^{-3}$ moles/l. of solution in the case of the alkali or ammonium thiosulfate and from $5.10^{-4}$ to $4.10^{-2}$ moles/l. of solution in the case of alkali or ammonium sulphocyanide. As regards phenidone, such quantities range from 0.010 to 1 g/l. of solution. As regards methol, they also range from 0.010 to 1 g/l. of solution. The pH value of the development is preferably comprised between 10 and 12.

As known to those skilled in the art, an acid fixing bath generally follows the development step to prevent this from continuing its action unwillingly. Such a bath can be further followed by a washing step. The silver halide emulsions obviously include silver halides, dispersed in a hydrophilic colloidal binder, such as for instance bromide, iodide and chloride or mixtures thereof, viz. bromo-iodide. They can also contain the conventional coating finals known to those skilled in the art, such as for instance chemical sensitizers, antifoggants, stabilizers, plasticizers, surfactants and optical sensitizers. The receptive layer essentially consists of colloidal silver nuclei dispersed in a hydrophilic colloidal binder. It also contains other coating finals known to those skilled in the art, such as surfactants, stabilizers, hardeners and antifoggants.

The hydrophilic colloidal binder can be of any type known to the skilled artisan, natural or synthetic, such as for instance that described in the U.S. Pat. Nos. 2,286,215; 2,328,808; 2,322,085; 2,527,872; 2,541,474; 2,563,791; 2,768,154; 2,808,331; 2,852,382. It will preferably consist of gelatin possibly containing dispersed particles of a hydrophobic polymer, such as for instance polyethylacrylate, to improve the physical characteristics of the obtained layer. The layers, thus obtained, can be hardened with the hardeners known to those skilled in the art, such as for instance epoxides, formaldehyde, glyoxale, succinic, glutaric, and resorcilic aldehyde, mucochloric and mucobromic acid, as described in the U.S. Pat. No. 2,080,019, or mixtures thereof, as described for instance in the U.S. Pat. No. 2,591,542. The base, of which the photographic element according to the present invention consists, can be chosen among those commonly known to the skilled artisan, such as for instance cellulose triacetate, polyester, paper, polyethylene coated paper.

In addition to the base, emulsion layer(s) and receptive layer(s), the photographic element of the present invention can also contain any auxiliary layer, such as protective layers, interlayers, subbing layers and antihalo layers, as known to those skilled in the art.

The presence of phenidone and thiosulfate together with p-phenylendiamine developer proved to be essential to the invention. Thiosulfate acts not only as a carrying agent but cooperates with phenidone and p-phenylendiamine developer in order to get better color densities, curve shape and contrast. In the particular case of non diffusing hydroquinone compounds present in the receptive layer, phenidone cooperates also with said hydroquinone compound in order to have the non-exposed silver ions reduced as colored yellow colloidal silver, while in the emulsion layer it cooperates with p-phenylendiamine developer to obtain a good coupling reaction. It is believed that when in the presence of non diffusing hydroquinone compounds in the receptive layer the process is, at least at a certain extent, the combination of a color development in the emulsion layer and a "black and white" development in the receptive layer. The presence of a hydroquinone compound in the receptive layer and phenidone in a developing bath having a pH which is from 10 to 12 lets us suppose, in fact, that the non exposed silver ions are reduced substantially by these compounds rather than by the p-phenylendiamine compound.

Thiosulphate is believed to be useful as cooperating with both color developers and "black and white" developers (as per above) to improve the quality of the obtained images.

The presence of both phenidone and thiosulfate, however, has been found to be crytical since greater than necessary amounts of these compounds proved to cause some drawbacks. For example, greater than necessary amounts of phenidone cause the formation of an excess of reduced silver with respect to the blue and yellow dyes, which results into an undesired change or dirtiness of the colors.

An excess of thiosulfate causes, for example, the formation of blue colored fog and the loss of density in the emulsion layer and change or dirtiness of yellow color in the receptive layer which results into a highly undesirable deterioration of the image quality.

Of course less than necessary amounts of both phenidone and thiosulfate are uneffective to the purposes of the present invention.

According to what above and what previously described in the present specification, development compositions according to the present invention containing from 1 to 15 g of p-phenylenediamine compound preferably from 6 to 10 g per liter of solution, have to contain preferably from 0.01 to 1.0 g, more preferably from 0.2 to 0.7 g of phenidone, and from $3 \times 10^{-4}$ to $6 \times 10^{-3}$ moles, preferably from $1.3 \times 10^{-3}$ to $3.2 \times 10^{-3}$ moles of an alkali or ammonium thiosulfate per liter of solution, these latter data substantially corresponding to from 0.05 to 1 g and respectively from 0.2 to 0.5 g of sodium thiosulfate which is presently being preferred.

The pH of said compositions is to be generally comprised between 10 to 12, preferably between 10.7 and 11.0.

The following illustrative examples provide a further teaching of the present invention. Examples A and B are examples of materials outside the present invention to which a comparison is presented with materials of this invention.

EXAMPLES OF PHOTOGRAPHIC MATERIALS

EXAMPLE A

A layer of silver bromo-iodide emulsion (3% iodide moles) including grains having an average diameter of 0.7 $\mu$, with a silver to gelatin ratio of 0.5 was coated on both faces of a colorless polyester base (thus obtaining a silver coating weight of 3 g/m²). The base had been provided with two "sublayers" essentially consisting of gelatin. The same emulsion layer contained two couplers: coupler No. 1 for blue and coupler No. 2 for magenta, as described hereinbefore, in a quantity of 0.186 M and 0.072 M/l gramatom of silver respectively. A protective layer, essentially consisting of gelatin, was then coated on both emulsion layers.

EXAMPLE 1

A material similar to the one described in Example A was prepared with the difference that colloidal silver nuclei were added to the "sublayers" (which became "receptive layers" according to the practice of this invention) included between the two emulsion layers and the base. The colloidal silver in the final layer was present in a quantity of 0.15% g. of gelatin, equal to 0.0018 g/m². The base with the two receptive layers, each having a thickness of 4.3 $\mu$, presented a density of about 0.085 (0.040 was the density of the base) read at a blue light at a Westrex Densitometer provided with Status A filters. Each receptive layer contained the conventional coating finals, such as surfactants, hardeners, antifoggants and stabilizers. The silver colloidal nuclei had been prepared by mixing under stirring the following parts, as shown below:

| | | |
|---|---|---|
| I | $H_2O$ | 600 ml. - 20°C |
| | NaOH | 61.6 g. |
| II | $H_2O$ | 2,400 ml. - 20°C |
| | Lysalbinic acid | 83.2 g. |
| III | $H_2O$ | 667 ml. - 20°C |
| | $AgNO_3$ | 160 g. |
| IV | $H_2O$ | 500 ml. - 20°C |
| | Tannic acid | 20.8 g. |
| V | $H_2O$ | 4,000 ml. - 65°C |
| | $NH_4OH$ (1:4) | 108 ml. |
| VI | $H_2O$ | 8,000 ml. - 45°C |
| | Gelatin | 800 g. |
| VII | $H_2O$ | 5,000 ml. - 45°C |

Under stirring, the following sequential steps were performed:

— II was poured into I in 1 minute

— III was added in 10 minutes to the resulting solution

— IV was added in 15 minutes to the solution resulting from the addition of III

The temperature was adjusted to 65°C in 3 min.

The mixture was left to stay for 10 minutes at 65°C

— V was added in 1 minute to the resulting solution

The temperature was adjusted to 45°C in 2 minutes

The mixture was left to stay for 1 minute at 45°C

— VI was added in 30 seconds to the resulting solution

The mixture was left to stay for 5 minutes at 45°C

— VII was added thereto in 5 minutes

The mixture was left to stay for 15 minutes at 45°C, then frozen and washed to a $1,200 \times 10^{-6}\ \Omega^{-1}$ conductivity.

EXAMPLE 2

A photographic element as in example 1 with the exception that the quantity of colloidal silver in the receptive layer was 0.0036 g/m². The density of the base with the two receptive layers (each having a thickness of about 4.3$\mu$), read in a Westrex densitometer at blue light provided with Status A filters, was about 0.110, while the density of the base alone was 0.040.

EXAMPLE 3

The material of the present example was composed as in example 1 with the exception that the quantity of colloidal silver in the receptive layer was 0.0072 g/m². The density of the base with the two receptive layers (each having a thickness of about 4.3 $\mu$), read at blue light in a Westrex densitometer provided with Status A filters was about 0.160, while the density of the base alone was 0.040.

EXAMPLE 4

The material of the present example was composed as in example 2 with the same colloidal silver quantity (0.0036 g/m²) in the receptive layer. It also contained the magenta forming coupler No. 2 in a quantity of 1 g/m² in the receptive layer.

EXAMPLE 5

The material of the present example was composed as in example 4 but the quantity of the magenta coupler No. 2 in the receptive layer was 2 g/m².

EXAMPLE 6

The material of the present example was composed as in example 4, but the quantity of the magenta forming coupler No. 2 in the receptive layer was 3 g/m².

EXAMPLE 7

The material of the present example was composed as in example 4, but the receptive layer contained the yellow forming coupler No. 3 in a quantity of 3 g/m² instead of the magenta forming coupler No. 2.

EXAMPLE 8

The material of the present example was composed as in example 2, wherein the receptive layer contained 0.0036 g/m² of colloidal silver. The emulsion however was difficult: the average diameter of the silver halide grains was 1.45 $\mu$ (nm) and the iodide content was 1.8%. The silver to gelatin ratio of this emulsion was about 0.8, while all the other quantities remained unchanged.

EXAMPLE 9

The material of the present example was composed as in example 8; the receptive layers, however, also contained the magenta forming coupler No. 2 in a quantity of 2 g/m².

EXAMPLE 10

The material of the present example was composed as in example 8; the receptive layer, however, also contained the yellow forming coupler No. 3 in a quantity of 3 g/m².

EXAMPLE 11

The material of the present example was composed as in example 2 but the receptive layer contained 0.0036 g/m² of colloidal silver. The emulsion, however, was different: the average diameter of the silver halide grains was the same but the iodide content was 7%. The silver to gelatin ratio of this emulsion was about 0.8, while all the other quantities remained unchanged.

EXAMPLE 12

The material of the present example was composed as in example 1. The difference was in the fact that a receptive layer like that under the emulsion layer was placed also on the top of said emulsion layer.

EXAMPLE 13

The material of the present example was composed as in example 2; the receptive layer also contained however 0.285 g/m² of diisoctyl hydroquinone.

EXAMPLE OF COLOR DEVELOPMENT COMPOSITIONS

EXAMPLE B

A color development composition of the formula below had been prepared:

| | |
|---|---|
| $H_2O$ | 800 ml. |
| Ethylene glycol | 3.5 ml. |
| Benzyl alcohol | 7 m. |
| Sodium hexamethaphosphate | 2.5 g. |
| Sodium sulfite anhydrous | 8 g. |
| N-ethyl-N-hydroxy-ethyl-p-phenylene diamine sulfate | 6 g. |
| Potassium hydroxide (35% solution) | 3 ml. |
| Potassium carbonate | 80 g. |
| Sodium bromide | 1 g. |
| Hydroxylamine chlorohydrate | 1 g. |
| 6-nitro-benzimidazole nitrate (1% solution) | 1.5 ml. |
| Water to make | 1,000 ml. |
| pH at 20°C | 10.90 ± 0.1 |

EXAMPLE 14

The color development composition of this example was like that of example B with sodium hyposulfite in a quantity of 0.3 g/l.

EXAMPLE 15

The color development composition was like that of example B; it also contained however sodium hyposulfite in a quantity of 0.3 g per liter and phenidone in a quantity of 0.2 g per liter. The X-ray materials described in the examples were exposed according to PH a.9 – 1964 and developed with the above-described color developers for 4 minutes at 20°C and further fixed for 3 minutes at 20°C with the applicant's F 11 fixing bath having the below-described formula. Sensitometric results were obtained and the most significant of these are given below (see examples 16, 17, 18 and 19).

| F 11 fixing bath formula | |
|---|---|
| $H_2O$ | 600 ml. |
| Sodium thiosulphate crystals | 400 g. |
| Sodium sulphite anhydrous | 36 g. |
| Acetic acid glacial | 14 ml. |
| Boric acid crystals | 10 g. |
| Potassium alum | 20 g. |
| $H_2O$ to make | 1000 ml. |
| pH at 20°C | 4.80 |

EXAMPLES OF THE COMBINATION MATERIAL-COLOR DEVELOPMENT COMPOSITION

EXAMPLE 16

This example refers to the results obtained by processing the materials listed below in the color development bath of example B, outside the present invention:

material of example A
material of example 2
material of example 4
material of example 12

Comparing the various materials processed in the developing bath of example B, outside the invention, it is apparent that the material of example A exhibits a slightly higher sensitivity and a lower yellow fog than the remaining materials. All additionally measured characteristics are the same. In all these trials a negative image and no positive image can be seen.

EXAMPLE 17

This example includes the results obtained by processing the materials, listed below, in the color developing bath of example 15 (0.3 g/l. of hypo and 0.2 g/l. of phenidone):

material of example A
material of example 2
material of example 4
material of example 12

The results are respectively shown in FIGS. 1–4. In each of these figures we find two curves corresponding to the readings at blue light (curve 1) and red light (curve 2) with a Westrex Densitometric provided by status A filters.

In the case of examples 2, 4, and 12, there is a third curve (curve 3) corresponding to the difference between the curve of the reading at blue light of the materials of the present invention and the curve of the material of example A (outside the invention). When the materials of examples 2, 4, and 12 were processed in the developing bath of example 15, a yellow positive image appeared in addition to the blue negative image corresponding to said curve 3.

When the material of example A was processed in the developing bath of the example 15, only a negative image appeared.

EXAMPLE 18

This example includes the results obtained by processing the materials (listed below) in the color developing bath of example 15 (0.3 g/l. of hypo and 0.2 g/l. of phenidone).

material of example 13
material of example 2

Figure 6:
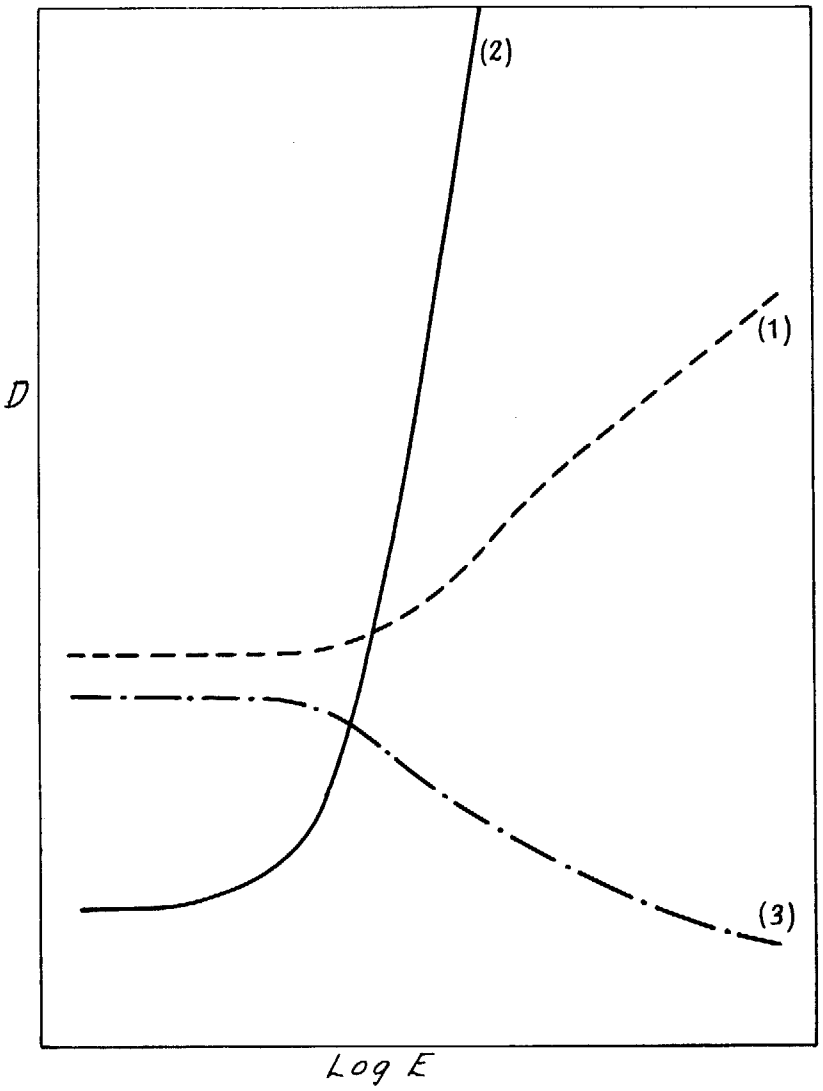
Figure 5:
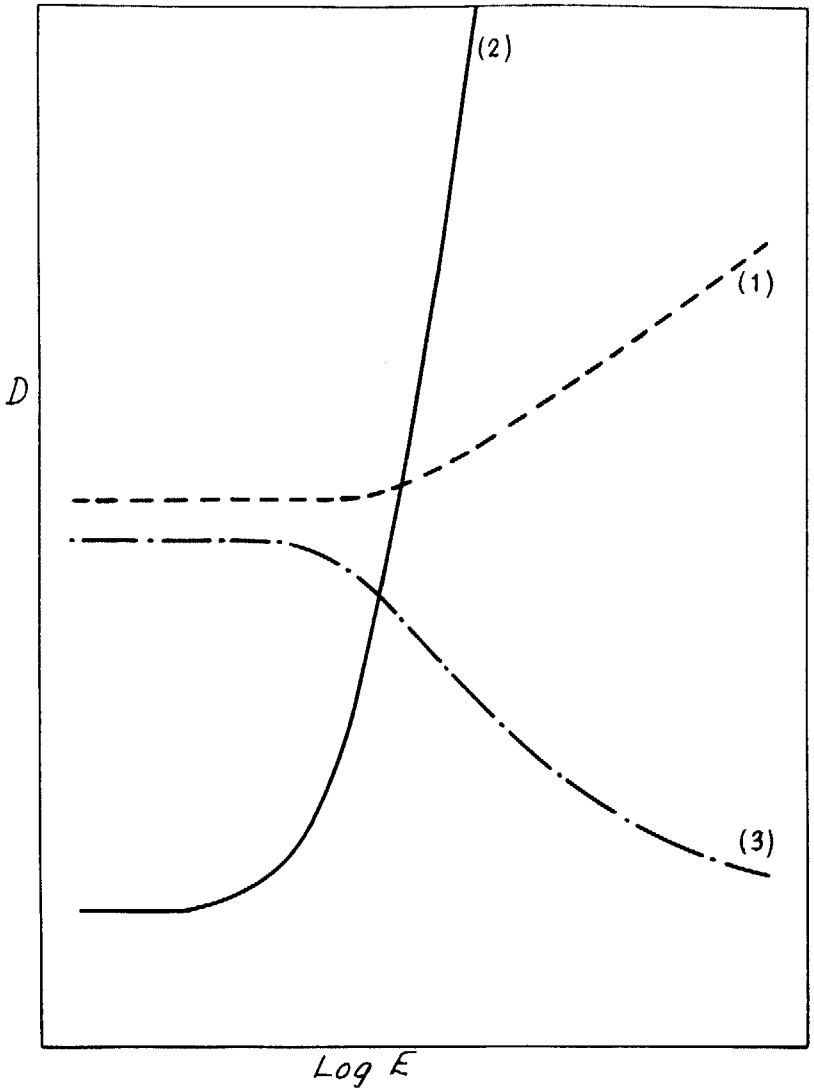

The results are shown in the enclosed FIGS. 5 and 6. In each of these FIGURES we can find three curves as described in example 17. By comparing one with another it can be seen that the yellow positive curve density is increased by introducing into the receiving layer (material of example 13) the diisooctylhydroquinone.

EXAMPLE 19

This example refers to the results obtained by processing the material of example 12 in the color developing baths of examples 14 and 15 (0.3 g/l. of hypo and 0.2 g/l. of phenidone).

Figure 8:
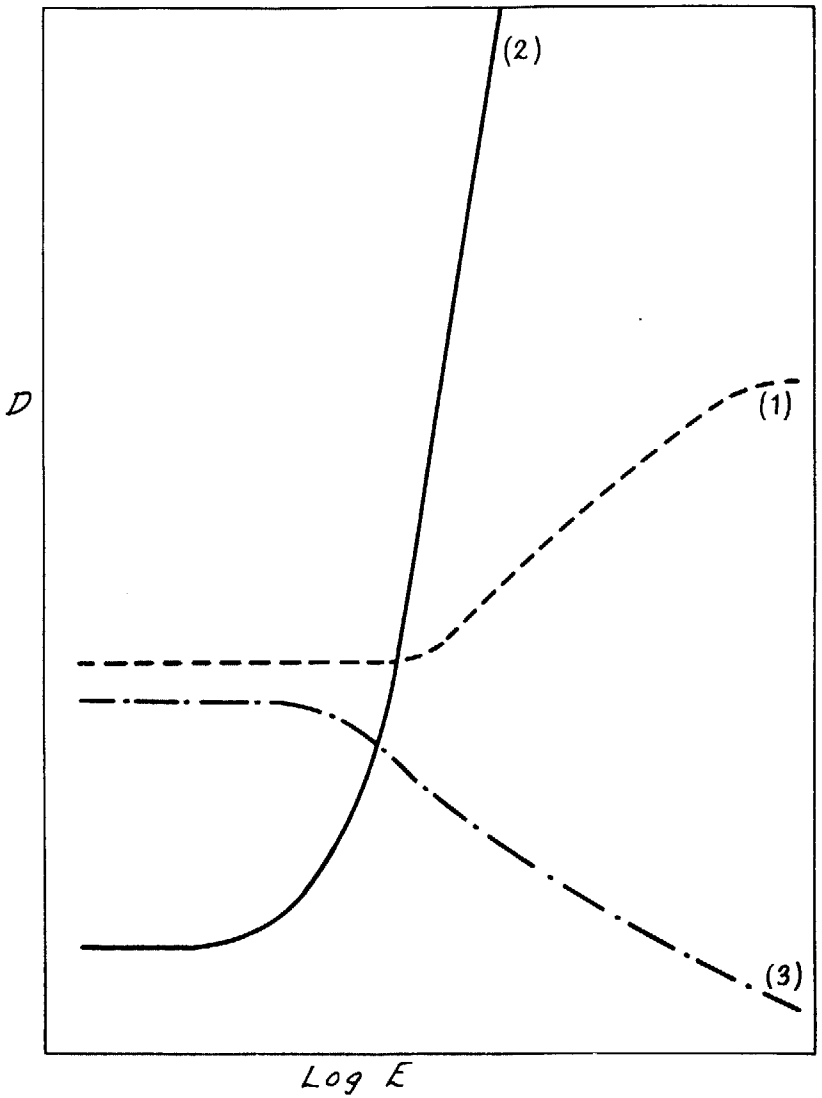
Figure 7:
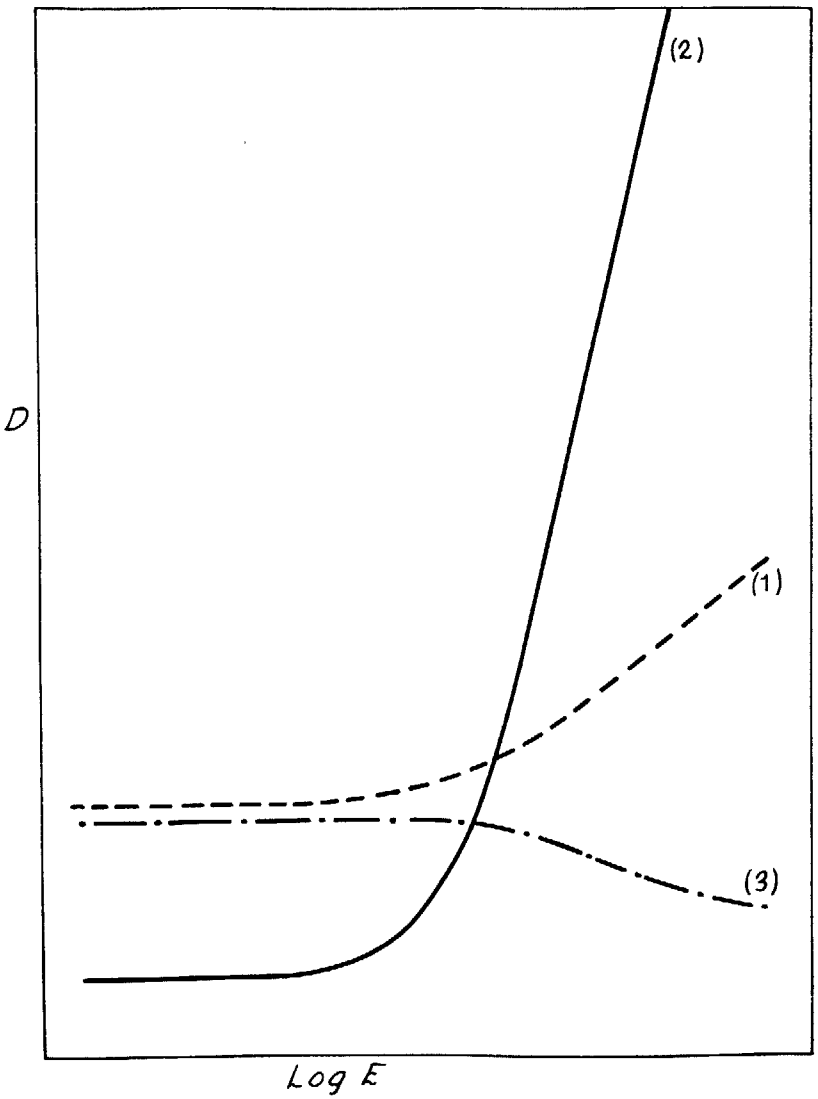

The results are shown in the enclosed FIGS. 7 and 8. In each of these figures three curves can be found as described in example 17. By comparing one with another, the usefulness of phenidone in the practice of this aspect of the invention can be seen.

EXAMPLE 20

Acutance dyes are preferably used to reduce spurious exposure of the silver halide emulsion by light scattering. The acutance dye is preferably in the receiving layer but may be in the emulsion layer if reduced speed is acceptable. The effect of an acutance dye (cf. *Emulsion Chemistry*, G. F. Duffin, Focal Press, 1966, p. 164) is shown in this example.

a. A material similar to that described in example 13 was prepared, the only difference being the addition of a green sensitizing dye (the anhydrous hydroxide of 3-3′-di- Ω-sulfobutyl-( 5,5′ -diphenyl-′-ethyl-oxacarbocyanine) into the emulsion layer in the quantity of 44.5 ml. (of a solution containing 1.0 grams dye in 500 ml. of methyl alcohol) per gram atom of silver.

b. A material similar to that described in example 13 was prepared, the only difference being the addition of a magenta acutance dye, azogeranine, to the receiving layers in a quantity of 0.0167 g/m$^2$ for each receiving layer. This corresponds to a density of about 0.08 when read with the green light of a Westrex Densitometer provided with filter status A.

The materials described in (a) and (b) were radiographically exposed through standard blue emitting, medium speed intensifying screens. Other samples of similar materials were similarly exposed except through green emitting intensifying screens. All exposed samples were processed in the solutions described in the color developing procedures of example 15. Material of (a) exhibited an increased speed of 0.1 over the material of example 13 when exposed to blue emitting screens while the material of (b) exhibited enhanced sharpness. When exposed by green emitting screens (a) and (b) respectively exhibited speeds higher than the material of example 13 by 0.8 Log E and 0.5 Log E. The material (b) also exhibited enhanced sharpness over the material of example 13.

What is claimed is:

1. A method for the formation of a color contrast photographic image consisting of processing an exposed photographic material including:

a. a base;

b. at least one layer of a silver halide photographic emulsion dispersed in a hydrophilic colloidal binder, reactively associated with at least one color coupler capable of yielding a substantially blue dye upon development with a p-phenylene diamine developer;

c. at least one hydrophilic colloidal binder receptive layer reactively associated with said emulsion layer; containing dispersed silver condensation nuclei for the formation of substantially yellow colored colloidal silver by development with an aqueous alkaline solution comprising:

d. a p-phenylene diamine developer, and e. a carrying agent for silver halide said condensation nuclei and said coupler being able to give rise to two different colors to form a color contrast image, yellow from the condensation nuclei and blue from the coupler, with (b) and (c) on the same side of said base.

2. The method of claim 1 in which said condensation nuclei consist of colloidal silver.

3. The method of claim 1 in which said receptive layer contains a color coupler.

4. The method of claim 1 characterized in that said aqueous alkaline solution contains phenidone or methol.

5. The method of claim 1 characterized in that said aqueous alkaline solution contains phenidone.

6. The method of claim 1 in which said carrying agent is the thiosulphate ion.

7. The method of claim 1 in which said carrying agent is the sulphocyanide ion.

8. The method of claim 1 wherein the carrying agent for silver halide is a silver halide solvent.

9. The method of claim 1 wherein the carrying agent for silver halide is a fixer.

10. A color contrast photographic element including:

a. a base;

b. at least one hydrophilic colloidal binder layer including a silver halide photographic emulsion reactively associated with a coupler capable of reacting with a color developer to form a substantially blue dye;

c. at least a hydrophilic colloidal binder receptive layer reactively associated with said emulsion layer, said receptive layer containing dispersed colloidal silver condensation nuclei, said condensation nuclei and said coupler being able, upon color development in the presence of a carrying agent to give rise to a color contrase image, the condensation nuclei generating substantially yellow colloidal silver and the coupler generating a substantially blue dye, with (b) and (c) on the same side of said base.

11. The photographic element of claim 10 in which said coupler is a phenol and/or naphtol compounds.

12. The photographic element of claim 10 in which said receptive layer contains a coupler.

13. The photographic element of claim 10 in which said receptive layer contains a non-diffusing hydroquinone.

* * * * *

UNITED STATES PATENT AND TRADEMARK OFFICE

CERTIFICATE OF CORRECTION

PATENT NO. : 3,933,494

DATED : January 20, 1976

INVENTOR(S) : Vinicio Busatto and Luigi Franchi

It is certified that error appears in the above-identified patent and that said Letters Patent are hereby corrected as shown below:

Column 13, line 67, "diphenyl-'-ethyl" should be --diphenyl-α-ethyl--.

Signed and Sealed this

Third Day of August 1976

[SEAL]

*Attest:*

RUTH C. MASON
*Attesting Officer*

C. MARSHALL DANN
*Commissioner of Patents and Trademarks*